US009353761B2

(12) United States Patent
Chang et al.

(10) Patent No.: US 9,353,761 B2
(45) Date of Patent: May 31, 2016

(54) OIL RETURN STRUCTURE FOR FAN

(71) Applicant: Asia Vital Components Co., Ltd., Sinjhuang District, New Taipei (TW)

(72) Inventors: Bor-Haw Chang, New Taipei (TW); Ping-Tsang Ho, New Taipei (TW); Chung-Shu Wang, New Taipei (TW); Jyun-Yang Chang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 444 days.

(21) Appl. No.: 13/906,306

(22) Filed: May 30, 2013

(65) Prior Publication Data

US 2014/0356170 A1 Dec. 4, 2014

(51) Int. Cl.

| | |
|---|---|
| ***F04D 29/063*** | (2006.01) |
| ***F04D 29/046*** | (2006.01) |
| ***F04D 29/056*** | (2006.01) |
| ***F04D 25/06*** | (2006.01) |

(52) U.S. Cl.

CPC ..... *F04D 29/063* (2013.01); *F04D 25/062* (2013.01); *F04D 29/046* (2013.01); *F04D 29/056* (2013.01); *F05D 2240/50* (2013.01); *F05D 2240/60* (2013.01)

(58) Field of Classification Search

CPC . F04D 29/046; F04D 29/0462; F04D 29/056; F04D 29/0563; F04D 25/062; F06D 2240/50; F06D 2240/60

See application file for complete search history.

(56) References Cited

U.S. PATENT DOCUMENTS

| | | | | |
|---|---|---|---|---|
| 7,518,272 | B2 * | 4/2009 | Yeh | H02K 7/085 310/67 R |
| 2002/0190602 | A1 * | 12/2002 | Huang | H02K 21/145 310/257 |
| 2008/0169733 | A1 * | 7/2008 | Lin | F04D 29/057 310/67 R |
| 2010/0272586 | A1 * | 10/2010 | Hsu | F04D 29/063 417/354 |
| 2010/0329901 | A1 * | 12/2010 | Horng | H02K 5/1675 310/90 |

* cited by examiner

*Primary Examiner* — Ninh H Nguyen

(57) ABSTRACT

An oil return structure for fan includes a base, a bearing, a retaining ring and a rotor. The base has a bearing cup internally defining a receiving space for receiving the bearing therein. The bearing has a centered and axially extended shaft hole. The retaining ring is located at a front end of the bearing and has a central hole. The rotor includes a hub and a shaft. The shaft is extended through the central hole of the retaining ring into the shaft hole of the bearing, and is provided with an annular groove corresponding to the retaining ring. Oil in the bearing flowing to the annular groove during fan operation is centrifugally pulled out of the shaft and then caught by the retaining ring, from where the oil returns to the bearing. Therefore, loss of oil from the bearing is largely reduced to ensure extended fan service life.

7 Claims, 6 Drawing Sheets

OIL RETURN STRUCTURE FOR FAN

FIELD OF THE INVENTION

The present invention relates to a fan oil return structure, and more particularly to a fan oil return structure that is helpful in extending fan service life and reducing fan maintenance cost.

BACKGROUND OF THE INVENTION

A cooling fan is very important to a computer and peripherals thereof because it directly influences the operating performance and stability and the service life of the central processing unit (CPU) and relevant internal components of the computer and other peripherals. The cooling fan is usually designed to meet the requirements of low operating vibration, low operating noise, high heat dissipation efficiency and long service life. In response to the present trend of reduced computer dimensions, the cooling fan therefor now also has small and compact design as well as low power consumption.

FIG. 1 is a sectional view of a conventional cooling fan, which generally includes a base 10, a stator 11 and a rotor 12. The rotor 12 includes a shaft 121 and an oil-impregnated bearing 122 that are rotatably assembled to each other to constitute a rotation support structure of the rotor 12. For the shaft 121 to maintain stable and smooth rotation, the oil-impregnated bearing 122 must be able to stably hold the shaft 121 therein. That is, how the oil-impregnated bearing 122 is mounted has important influence on the operating stability of the rotor 12. When the cooling fan operates, the shaft 121 spins quickly in a shaft hole 1221 of the oil-impregnated bearing 122 and brings the lubricant oil pre-filled in the bearing 122 to move forward along the shaft 121. This condition causes the lubricant oil in the bearing 122 to gradually decrease with time and eventually result in loss of oil from the bearing 122. The decrease or loss of the lubricant oil would inevitably lead to an increased friction coefficient between the shaft 121 and the oil-impregnated bearing 122 and accordingly high operating temperature of the cooling fan, which all have adverse influence on the smooth rotation of the fan to shorten the service life thereof.

In brief, the conventional cooling fan design has the following disadvantages: (1) shortened fan service life; and (2) increased fan maintenance cost.

It is therefore tried by the inventor to work out a way to overcome the above disadvantages of the conventional cooling fan design.

SUMMARY OF THE INVENTION

A primary object of the present invention is to provide an oil return structure for fan, so as to ensure extended fan service life.

Another object of the present invention is to provide an oil return structure for fan, so as to enable reduced fan maintenance cost.

To achieve the above and other objects, the oil return structure for fan according to the present invention includes a base, a bearing, a retaining ring and a rotor. The base has a bearing cup, which internally defines a receiving space for receiving the bearing therein. The bearing has a centered and axially extended shaft hole. The retaining ring is located at a front end of the bearing and has a central hole. The rotor is mounted on the base and includes a hub and a shaft rearward extended from a center of the hub. The shaft is extended through the central hole of the retaining ring into the shaft hole of the bearing, and is provided at a position corresponding to the retaining with an annular groove.

When a fan with the oil return structure according to the present invention operates, the shaft spins and brings the oil in the bearing to move forward along the shaft toward the hub. When the oil reaches at the annular groove, it is stopped by a step between the annular groove and an outer surface of the shaft from moving along the shaft any further, and is centrifugally pulled out of the shaft. The oil being centrifugally pulled out of the shaft is caught by the retaining ring, from where the oil returns to the bearing. With the oil return structure, loss of oil from the bearing during fan operation can be largely reduced to thereby ensure increased fan service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
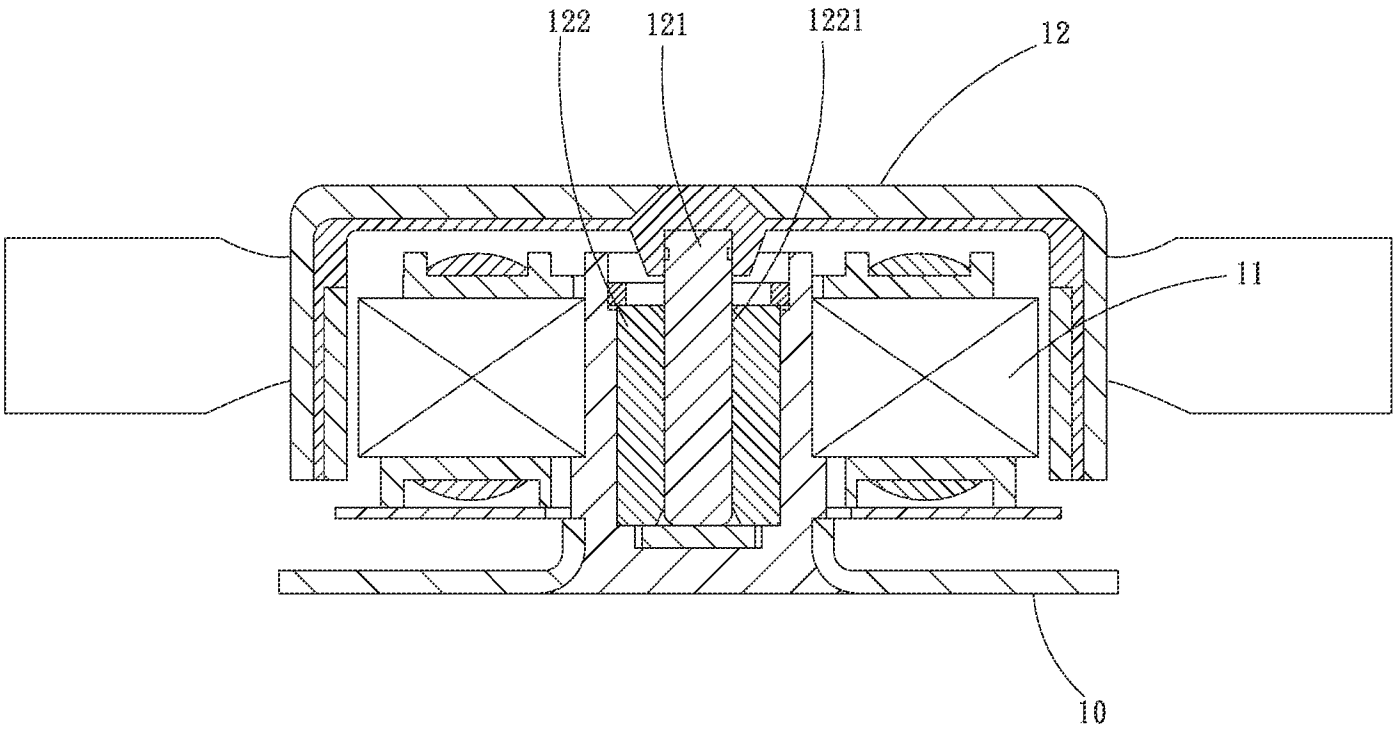
(PRIOR ART) Fig. 1
FIG. 1 is a sectional view showing a conventional cooling fan design.

The present invention will now be described with some preferred embodiments thereof and with reference to the accompanying drawings. For the purpose of easy to understand, elements that are the same in the preferred embodiments are denoted by the same reference numerals.

Figure 2:
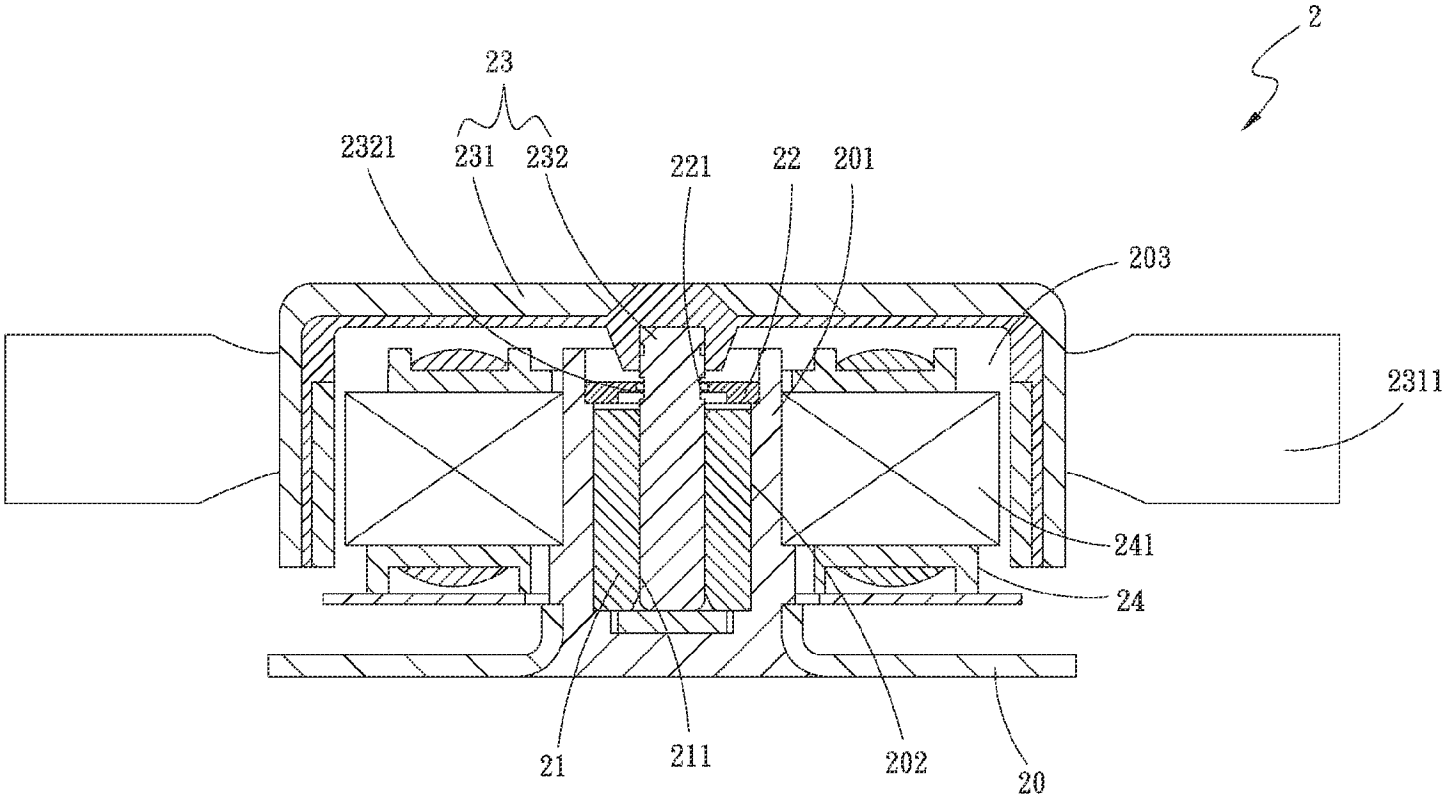
FIG. 2 is a sectional view showing an oil return structure for fan according to a first embodiment of the present invention.

Please refer to FIG. 2 that is a sectional view showing an oil return structure for fan according to a first embodiment of the present invention. For the purpose of conciseness, the present invention is also briefly referred to as the fan oil return structure or simply the oil return structure herein and is generally denoted by reference numeral 2. As shown, the fan oil return structure 2 includes a base 20, a bearing 21, a retaining ring 22, and a rotor 23. The base 20 has a bearing cup 201, which internally defines a receiving space 202. An annular space 203 is externally formed around the bearing cup 201 of the base 20 for mounting a stator 24 therein. The stator 24 includes a plurality of silicon steel plates 241 fitted around the bearing cup 201.

The bearing 21 is fitted in the receiving space 202 of the bearing cup 201, and is provided with a centered and axially extended shaft hole 211.

The retaining ring 22 is located before a front end of the bearing 21 and has a central hole 221. In the present invention, the retaining ring 22 can be made of a metal material or a polymeric material.

The rotor 23 is mounted on the base 20, and includes a hub 231, a shaft 232 rearward extended from a center of the hub 231, and a plurality of blades 2311 spaced along an outer circumferential surface of the hub 231. The shaft 232 is extended through the central hole 221 of the retaining ring 22 into the shaft hole 211 of the bearing 21. Further, an annular groove 2321 is provided on an outer surface of the shaft 232 at a position corresponding to the retaining ring 22, forming a step at a juncture of the annular groove 2321 and the outer surface of the shaft 232.

When a fan with the above oil return structure operates, the spinning shaft 232 would bring the oil in the bearing 21 to move forward along the shaft 232 toward the hub 231. When the oil reaches at the juncture of the outer surface of the shaft 232 and the annular groove 2321, it is stopped by the step at the juncture from moving along the shaft 232 any further, and is centrifugally pulled out of the shaft 232. The oil being centrifugally pulled out of the shaft 232 is caught by the retaining ring 22, from where the oil returns to the bearing 21. With the oil return structure, loss of oil from the bearing 21 during fan operation can be largely reduced to thereby ensure increased fan service life and reduced fan maintenance cost.

Figure 3:
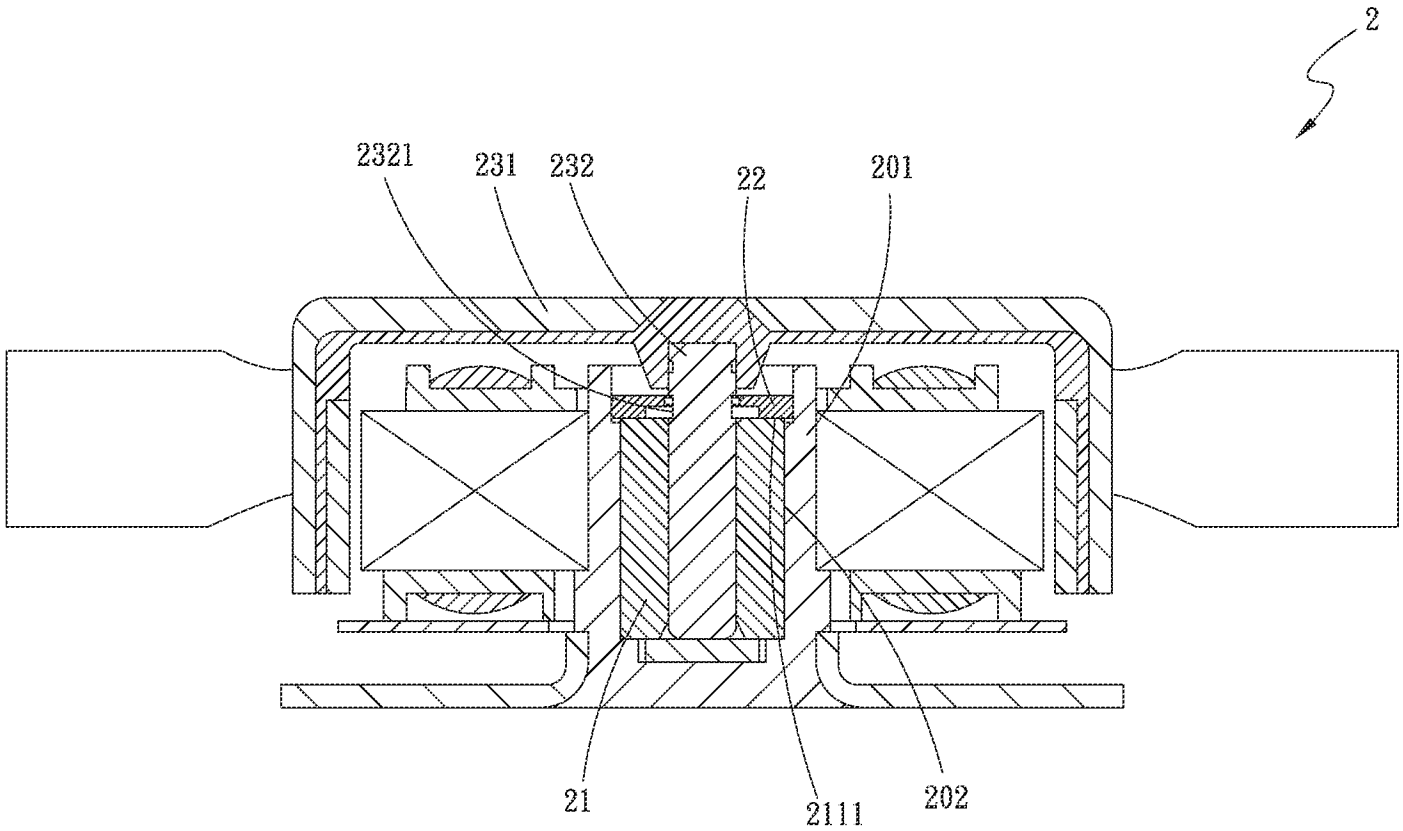
FIG. 3 is a sectional view showing an oil return structure for fan according to a second embodiment of the present invention.

FIG. 3 is a sectional view showing an oil return structure for fan according to a second embodiment of the present invention. Please refer to FIGS. 2 and 3 at the same time. While the fan oil return structure in the second embodiment is generally structurally similar to that in the first embodiment, it is different from the first embodiment mainly in that the retaining ring 22 is immediately located on a front end surface 2111 of the bearing 21. When the fan operates, the spinning shaft 232 brings the oil in the bearing 21 to move forward along the shaft 232 toward the hub 231. When the oil reaches at the juncture of the outer surface of the shaft 232 and the annular groove 2321, it is stopped by the step at the juncture from moving along the shaft 232 any further, and is centrifugally pulled out of the shaft 232. The oil being centrifugally pulled out of the shaft 232 is caught by the retaining ring 22, from where the oil returns to the bearing 21. With the oil return structure, loss of oil from the bearing 21 during fan operation can be largely reduced to thereby ensure increased fan service life.

Figure 4:
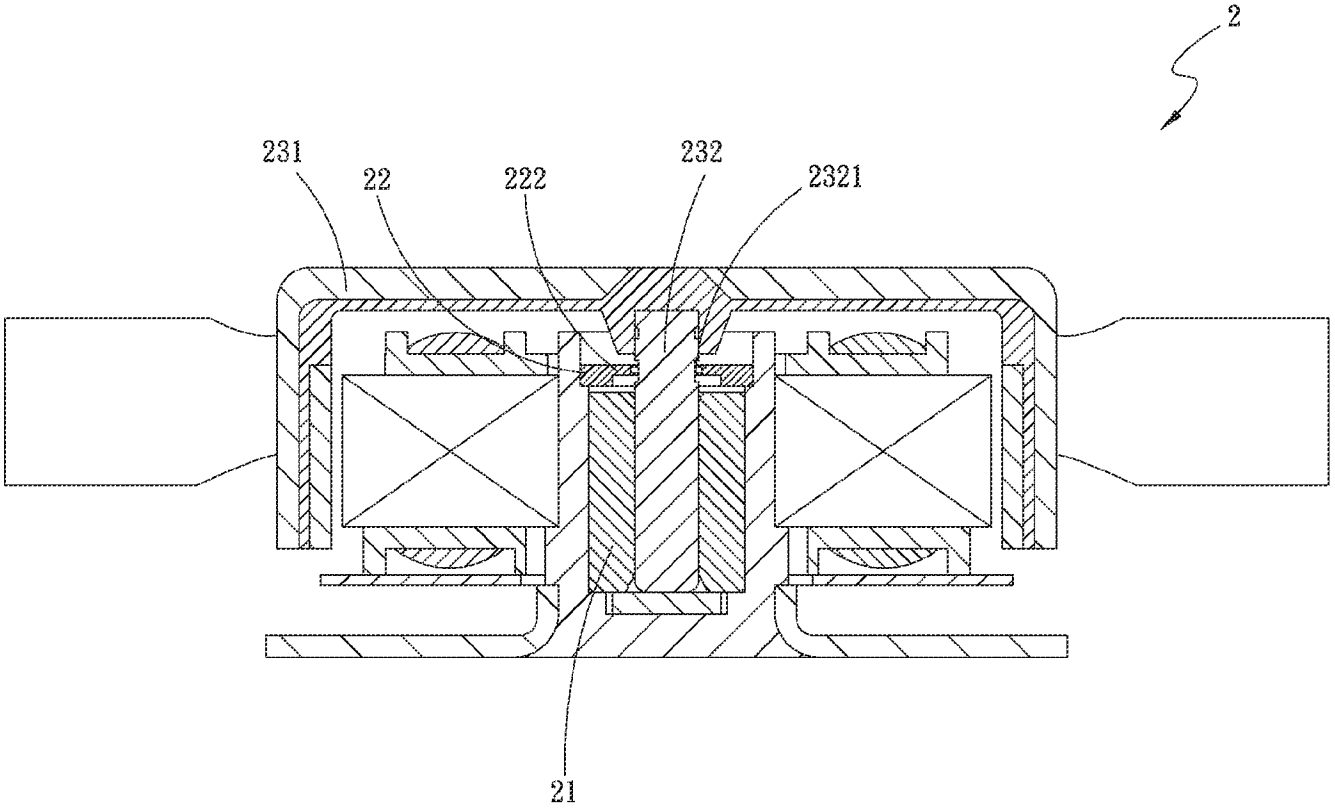
FIG. 4 is a sectional view showing an oil return structure for fan according to a third embodiment of the present invention.

FIG. 4 is a sectional view showing an oil return structure for fan according to a third embodiment of the present invention. While the fan oil return structure in the third embodiment is generally structurally similar to those in the previous embodiments, it is different from the previous embodiments mainly in that the retaining ring 22 includes an annular stop portion 222 radially inward extended into the annular groove 2321 on the shaft 232. Similarly, when the fan operates, the spinning shaft 232 brings the oil in the bearing 21 to move forward along the shaft 232 toward the hub 231. When the oil reaches at the juncture of the outer surface of the shaft 232 and the annular groove 2321, it is stopped by the step at the juncture from moving along the shaft 232 any further, and is centrifugally pulled out of the shaft 232. The oil being centrifugally pulled out of the shaft 232 is caught by the stop portion 222 of the retaining ring 22, from where the oil returns to the bearing 21. With the oil return structure, loss of oil from the bearing 21 during fan operation can be largely reduced to thereby ensure increased fan service life.

Figure 5A:
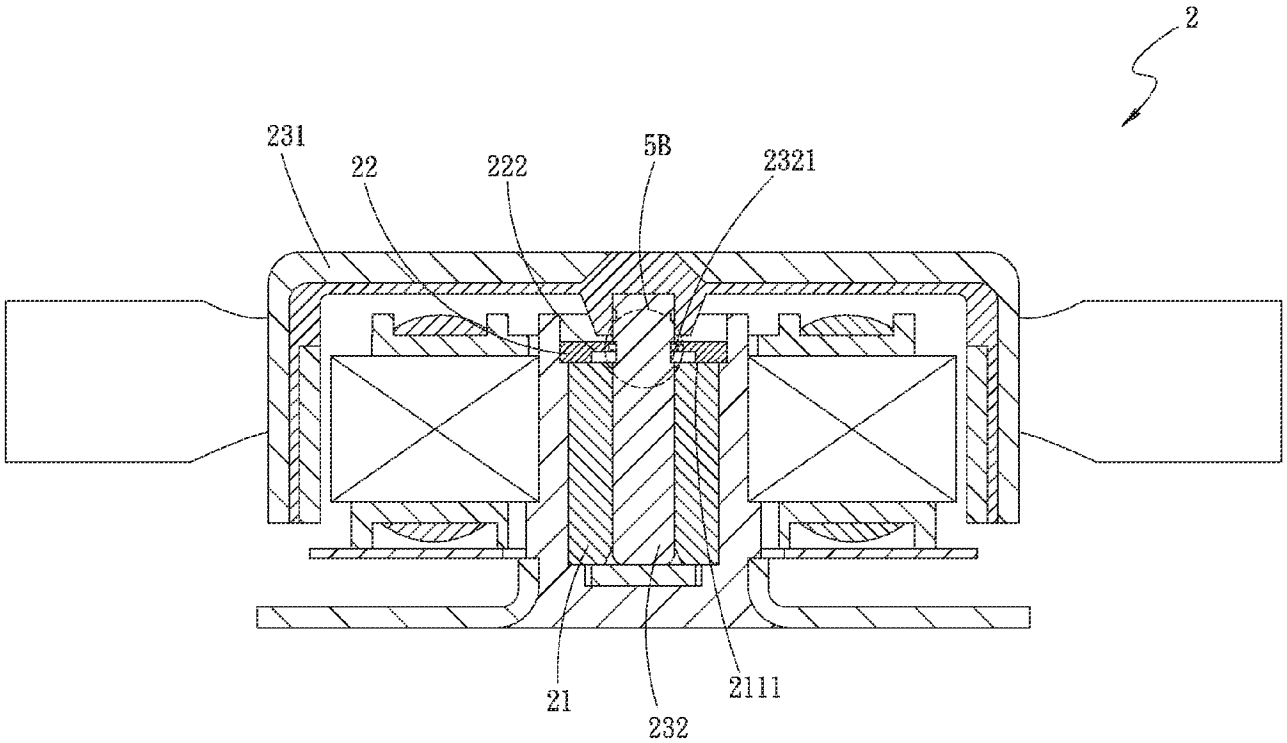
FIG. 5A is a sectional view showing an oil return structure for fan according to a fourth embodiment of the present invention.
Figure 5B:
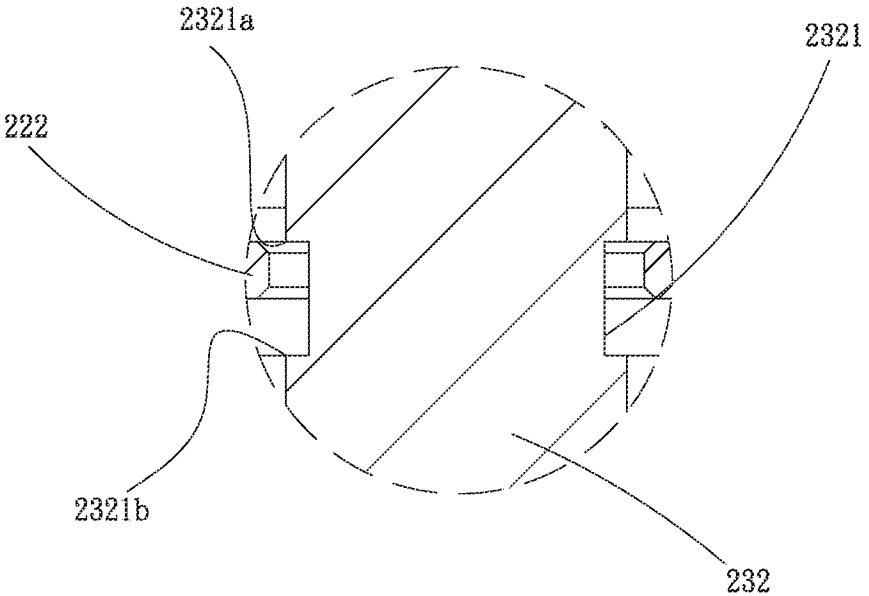
FIG. 5B is an enlarged view of the circled area in FIG. 5.

Please refer to FIG. 5A, which is a sectional view showing an oil return structure for fan according to a fourth embodiment of the present invention, and to FIG. 5B, which is an enlarged view of the circled area in FIG. 5A. While the fan oil return structure in the fourth embodiment is generally structurally similar to that in the third embodiment, it is different from the third embodiment mainly in that the annular groove 2321 defines a front stepped portion 2321*a* and a rear stepped portion 2321*b*, which are located around a front and a rear end of the annular groove 2321, respectively. The stop portion 222 of the retaining ring 22 has a top surface flush with the front stepped portion 2321*a*, and the front end surface 2111 of the bearing 21 is flush with the rear stepped portion 2321*b*. Similarly, when the fan operates, the spinning shaft 232 brings the oil in the bearing 21 to move forward along the shaft 232 toward the hub 231. When the oil reaches at the juncture of the outer surface of the shaft 232 and the annular groove 2321, it is stopped by the rear stepped portion 2321*b* at the juncture from moving along the shaft 232 any further, and is centrifugally pulled out of the shaft 232. The oil being centrifugally pulled out of the shaft 232 is caught by the retaining ring 22, from where the oil returns to the bearing 21. With the oil return structure, loss of oil from the bearing 21 during fan operation can be largely reduced to thereby ensure increased fan service life and reduced fan maintenance cost.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An oil return structure for fan, comprising:

a base having a bearing cup, which internally defines a receiving space;

a bearing being fitted in the receiving space of the bearing cup and provided with a centered and axially extended shaft hole and a front end surface;

a retaining ring being immediately located on the front end surface of the bearing and before a front end of the bearing and having a central hole; and a rotor being mounted on the base, and including a hub and a shaft rearward extended from a center of the hub; the shaft being extended through the central hole of the retaining ring into the shaft hole of the bearing, and being provided on an outer surface at a position corresponding to the retaining ring with an annular groove, so that a step is formed at a juncture of the annular groove and the outer surface of the shaft;

wherein the retaining ring has a flat upper surface and includes an annular stop portion in the form of a recess in the underside of the retaining ring extended radially inward toward the shaft; and wherein the annular groove defines a front stepped portion and a rear stepped portion located around a front and rear end of the annular groove, respectively, and a gap is formed between the annular stop portion and the rear stepped portion.

2. The oil return structure for fan as claimed in claim 1, wherein an annular space is externally formed around the bearing cup of the base for mounting a stator therein.

3. The oil return structure for fan as claimed in claim 2, wherein the stator includes a plurality of silicon steel plates fitted around the bearing cup.

4. The oil return structure for fan as claimed in claim 1, wherein the annular stop portion of the retaining ring is correspondingly extended into the annular groove on the shaft.

5. The oil return structure for fan as claimed in claim 1, wherein the annular stop portion of the retaining ring has a top surface flush with the front stepped portion; and the front end surface of the bearing is flush with the rear stepped portion.

6. The oil return structure for fan as claimed in claim 1, wherein the retaining ring is made of a material selected from the group consisting of a metal material or a polymeric material.

7. The oil return structure for fan as claimed in claim 1, wherein the rotor further includes a plurality of blades spaced along an outer circumferential surface of the hub.

* * * * *